United States Patent [19]

Holodnak

[11] Patent Number: 4,922,817

[45] Date of Patent: May 8, 1990

[54] SECURE SHUTTER LOCKING ARRANGEMENT FOR A POSTAGE METER

[75] Inventor: Richard S. Holodnak, Stratford, Conn.

[73] Assignee: Pitney Bowes Inc., Stamford, Conn.

[21] Appl. No.: 218,753

[22] Filed: Jul. 13, 1988

[51] Int. Cl.[5] ..... B41L 47/46

[52] U.S. Cl. ..... 101/91; 292/144

[58] Field of Search ..... 292/144; 101/91

[56] References Cited

U.S. PATENT DOCUMENTS

| | | | |
|---|---|---|---|
| 2,746,382 | 5/1956 | Hanson | 101/91 |
| 4,506,344 | 3/1985 | Hubbard | 364/900 |
| 4,509,347 | 4/1985 | Young | 292/144 X |
| 4,509,780 | 4/1985 | Erwin | 292/145 X |
| 4,593,543 | 6/1986 | Stefanek | 292/144 X |
| 4,634,155 | 1/1987 | Geringer et al. | 292/144 |
| 4,671,086 | 6/1987 | Fogleman et al. | 292/144 X |

*Primary Examiner*—Lloyd A. Gall

*Attorney, Agent, or Firm*—Michael J. DeSha; David E. Pitchenik; Melvin J. Scolnick

[57] ABSTRACT

An improved locking apparatus for preventing access to the print die of a postage meter which is protected by a shutter when it is removed from its base include a carriage and slide crack which are reciprocated by a solenoid in a direction transverse to the deadbolt which locks the shutter from moving. The operation of the carriage and slide crank prevent the deadbolt from being reciprocated by force applied to the deadbolt. A groove in the deadbolt interlocks with a slot on the shutter to allow the solenoid to be deactuated. A return spring in the solenoid is sized to prevent acceleration forces from moving the deadbolt.

10 Claims, 3 Drawing Sheets

SECURE SHUTTER LOCKING ARRANGEMENT FOR A POSTAGE METER

BACKGROUND OF THE INVENTION

The invention relates to postage meters and more particularly to postage meters of the type in which the postage meter portion including the die for printing the indicia is removable from a base which includes the platen and wherein a shutter or plate that covers the die is used to protect the indicia die from tampering whenever the postage meter is removed from the base.

A postage meter having such a shutter arrangement is described in the U.S. patent application Ser. No. 114,363 filed Oct. 27, 1987, entitled A REMOVABLE POSTAGE METER HAVING AN INDICIA COVER, assigned to the assignee of the present invention. In the shutter arrangement described in this referenced application, when the meter is properly mounted on the base, the shutter may be moved so as to uncover the die. A solenoid-operated deadbolt within the meter normally protrudes into a hole or recess in the shutter in order to prevent the shutter from being moved to expose the die while the meter is not properly installed. While this locking arrangement works well under typical conditions, there may be ways to defeat the security of this deadbolt arrangement, for example, by dropping the meter or applying other acceleration forces to the solenoid in order to jostle the deadbolt out of the recess. Since the shutter mechanism still must be actuable only when the meter is mounted on an appropriate base, there is a problem in respect of meeting each of the aspects of security constraints imposed by this type of postage meter.

It is therefore an object of the invention to provide an improved shutter locking arrangement which will inhibit unauthorized or accidental efforts to unlock the shutter by application of acceleration forces to the postage meter.

It is a further object to provide a locking arrangement wherein the deadbolt locking arrangement can not be defeated by simply pulling the deadbolt through the cover of the postage meter.

SUMMARY OF THE INVENTION

In accordance with the invention the improved locking arrangement comprises a deadbolt assembly which includes a housing which carries a deadbolt, a pivotable slide crank and a carriage connected to said deadbolt for reciprocating the deadbolt, and a solenoid connected to the carriage for actuating the carriage for reciprocating the deadbolt, the deadbolt being disposed in relation to a shutter on the postage meter so that in one position of the deadbolt the shutter is engaged with said deadbolt to thereby prevent movement of the shutter and in another position of the deadbolt the shutter is free to move.

In a preferred embodiment of the invention, the carriage includes a slot profile which captures a stud or pin on the deadbolt and the pivot of the slide crank is disposed in line with the pin of the deadbolt so that any attempt to simply pull the deadbolt outward from its locked position is blocked.

DESCRIPTION OF THE PREFERRED EMBODIMENT

Figure 1:
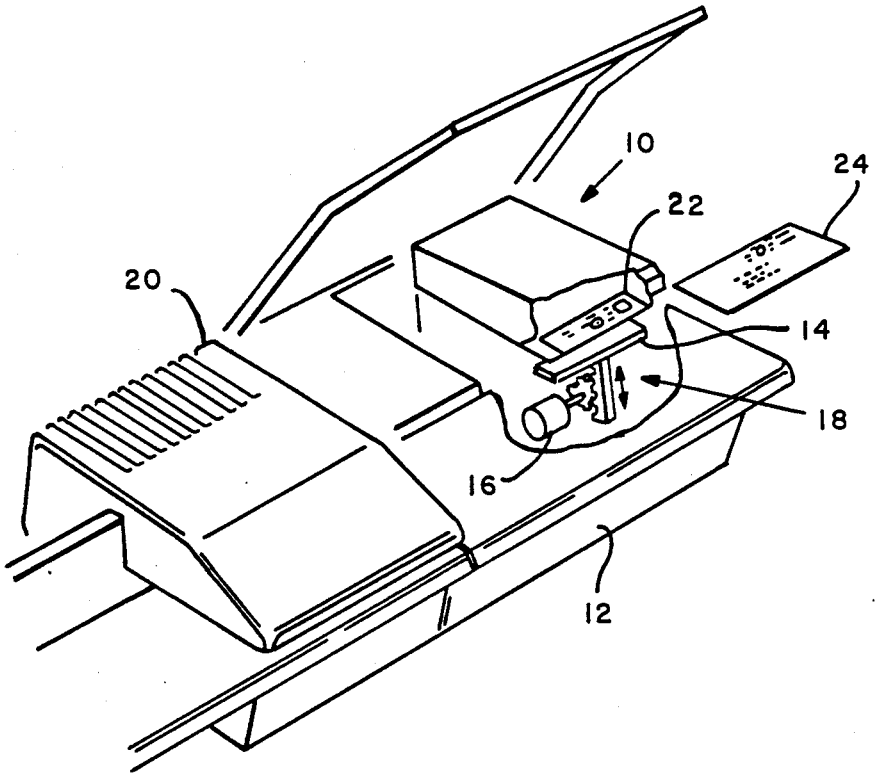
FIG. 1 is a perspective view of a meter which may incorporate the invention shown installed on a mailing machine.

FIG. 1 is a perspective view of a meter 10 which may incorporate the locking arrangement in accordance with the invention shown installed in mailing machine 12. The mailing machine has schematically shown therein a printing platen 14 reciprocally driven by motor 16 through rack and pinion mechanism indicated at 18. Feeder module 20 feeds mailpieces to the mailing machine 12 for imprinting by meter indicia printing die 22 on a mail piece 24 shown being ejected from the mailing machine. The meter 10 is removable from the mailing machine and the platen 14 remains in the mailing machine 12 when the meter is removed. It is thus necessary to preclude access to the indicia printing die 22 when the meter is removed from the mailing machine.

Figure 2A:
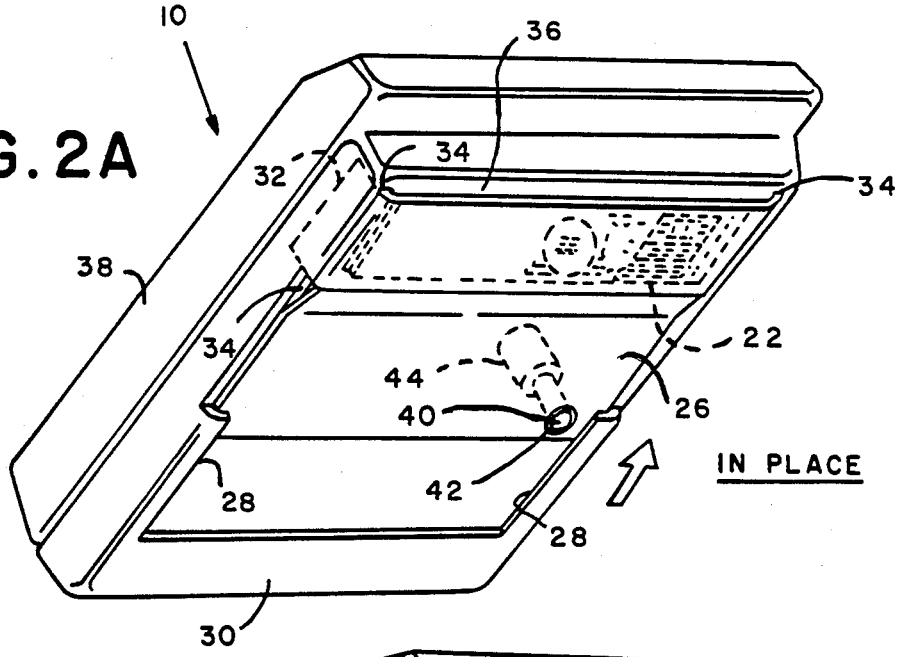
FIG. 2A is a perspective view of the meter showing indicia print die and the sliding shutter in the closed position being held in position by a deadbolt.
Figure 2B:
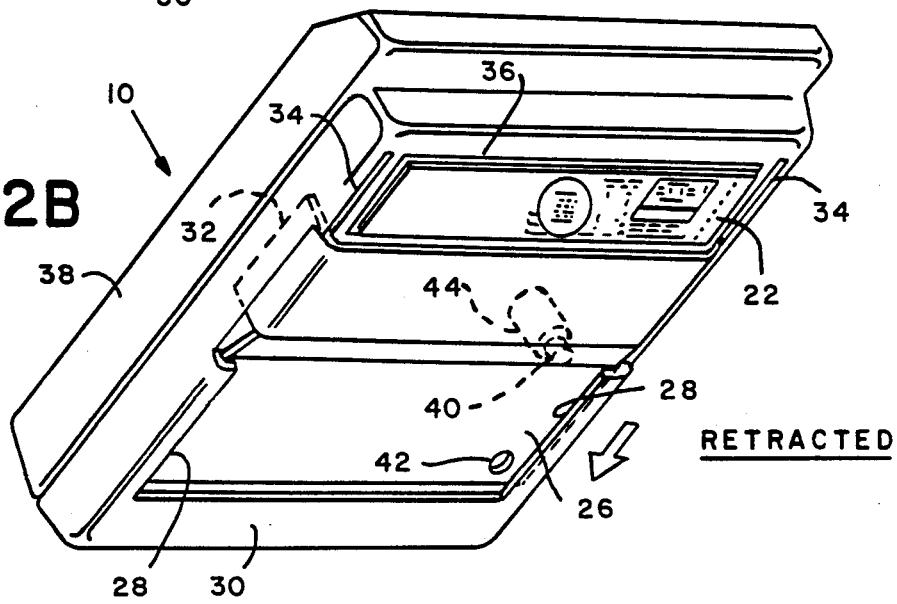
FIG. 2B shows the shutter in its retracted position.

FIG. 2A shows a perspective view of the meter 10. The illustrated meter 10 is a flat-bed printer with an elastomer print die. Such a meter is described in U.S. patent application Ser. No. 114,363 filed Oct. 27, 1987 entitled REMOVABLE POSTAGE METER HAVING AN INDICIA COVER assigned to the assignee of the present invention and specifically incorporated by reference herein. Sliding plate or shutter 26 is slidingly received in grooves 28 on the periphery of the bottom portion 30 of the meter 10. The shutter 26 includes flanges 32 captured in slots 34 between inner wall 36 of the meter and the meter cover 38. In order to prevent access to the indicia printing die 22, the shutter 26 is locked in the closed position by deadbolt 40 which extends into a hole-or blind bore 42 to prevent the shutter 26 from being moved from the closed position. The deadbolt 40 is actuated by spring-loaded solenoid 44. Whenever the solenoid is actuated to retract the deadbolt, the shutter can be moved to its retracted position to uncover the die 22 as shown in FIG. 2B.

Figure 3:
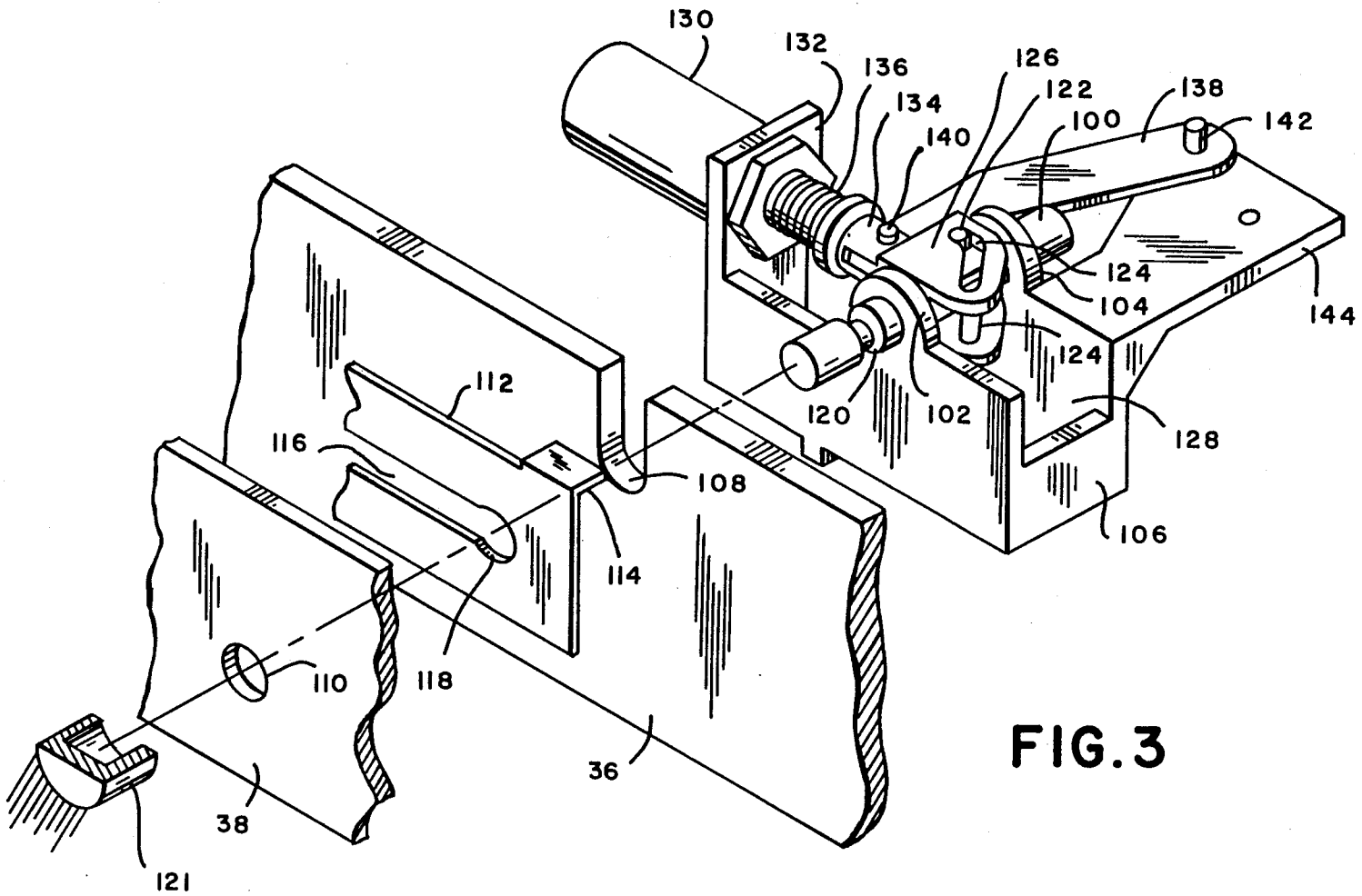
FIG. 3 is an exploded perspective view of the meter shutter locking arrangement in accordance with the invention with some of the external parts being partially shown for ease of viewing.

FIG. 3 is an exploded perspective view of an improved deadbolt locking arrangement in accordance with the invention. Deadbolt 100 is mounted for reciprocation within bores in ears 102 and 104 projecting from housing 106. Housing 106 is in turn mounted by suitable means (not shown) within the meter 10 such that when deadbolt 100 is fully retracted, it extends outwardly through opening 108 in the inner wall 36 of the meter and into hole 110 in meter cover 38.

Flange 112 of shutter 26, sliding between inner wall 36 and cover 38, has the same general shape and function as illustrated in FIG. 2A includes lip 114 which rides on the top of wall 36. Slot 116 in flange 112 runs parallel to the bottom of the meter and ends in an enlarged portion 118 which will accommodate the deadbolt in its retracted position, locking the flange 112 and hence shutter 26 in closed position to protect the indicia printing die as described previously.

Deadbolt 100 has an annular groove 120 such that the diameter of the deadbolt within the groove is less than the width of the slot 116. In accordance with the invention, when the deadbolt is extended, the groove 120 of the deadbolt is aligned with the slot 116. Since the deadbolt groove 120 in this position may be accommodated within slot 116, the flange 112 is free to move past the deadbolt 100 and the shutter may be moved to its retracted position uncovering the die. Such movement may be accomplished by mechanical means as described for example in U.S. application Ser. No. 114,363 previously incorporated by reference. Preferably, the deadbolt in its extended position is inserted into a mating receptacle such as bushing 121 mounted in the mailing machine in order to assure proper registration of the meter in the mailing machine interlocking deadbolt into receptacle 121 prevents lifting meter off of base and exposing indicia.

Returning now to the locking assembly, the deadbolt 100 has pins or studs 122 (shown in section) projecting outwardly which are captured in slots 124 of carriage 126. The pins may be capped by any suitable means (not shown) to hold them within the slots. Carriage 126 reciprocates in slot 128 of housing 106. It will be appreciated that because the pins are cammed in slots 124, reciprocation of the carriage 126 will cause the reciprocation of deadbolt 100 between the extended and retracted position.

Solenoid 130 is mounted on arm 132 of housing 106 and the solenoid plunger 134 connected to carriage 126 for reciprocation of the carriage. Return spring 136 is arranged to return the carriage to the locked position when the solenoid 130 is not energized and the annular groove 120 of the deadbolt 100 is not in slot 116.

One end of the slide crank 138 is pivotally connected to the plunger 134 and carriage 126, suitably by means such as pin 140 and the other end is pivotally attached by means such as pin 142 at a point on flange 144 of housing 106. Pin 142 is located preferably so that the direction of travel of the deadbolt is on the common center of the slot profile of the carriage and slide crank pivot. It will be appreciated by one skilled in the art that the location of the pivot at this point precludes a perpetrator from simply pulling the deadbolt through the cover of the meter to the extended position which enables the shutter to be moved.

For best results, the force of the return spring 136 is designed to be several times the mass of the slide crank 138 and solenoid plunger 134. This force will ensure that the deadbolt cannot be inadvertently extended if the meter is dropped. It will also be appreciated that, in accordance with the invention, it is necessary that the deadbolt be in precise alignment for the movement of the shutter. Simply jostling the deadbolt will not enable the shutter to move.

Turning now to the operation of the meter locking arrangement in accordance with the invention, it will be appreciated that when the meter 10 is off the mailing machine 12, the shutter 26 is in the forward secure position covering the indicia print die 22. Deadbolt 100 is in the retracted position and protrudes outwardly through opening 106 in meter wall 36 thereby capturing enlarged opening 118 in a shutter flange 112 to prevent movement of the shutter 26. As previously mentioned, even though the end of deadbolt 100 is accessible through hole 110 of the top cover of the meter, the locking arrangement prevents one from pulling the deadbolt 100 outwardly, since any direct outward pull on the deadbolt 100 will not translate to a force for moving the carriage 126 in the transverse direction. The return spring 136 prevents any acceleration forces from moving the carriage 126.

When the meter 10 is installed on the mailing machine 12, and communication between the mailing machine 12 and meter 10 is established as desired, the solenoid 130 is actuated to put the carriage 126 toward the solenoid. As the solenoid pulls in, pins 122 riding in slots 124 are cammed to move the deadbolt 100 outwardly to matingly lock with bushing 121 in the mailing machine.

In this condition, the grooves 120 on the deadbolt will be aligned with shutter flange slot 116 to allow the shutter 26 to be moved rearward to uncover the print die. It will be appreciated that once the shutter has begun to move, slot 116 is interlocked with the groove 120 and the solenoid 130 can be de-energized. When the shutter is again moved forward to the closed position, the slot is no longer interlocked with the deadbolt and the return spring 136 returns the carriage 126 to its originally position thereby camming the pins 122 in slots 124 to retract the deadbolt 100 to the position where movement of the shutter 26 is again blocked.

What is claimed is:

1. An improved locking apparatus for a postage meter having a shutter comprising:

a housing;

a deadbolt reciprocatingly mounted in said housing, said deadbolt being movable between a first position wherein a shutter for protecting a postage meter print die is moveable and a second position where said shutter is locked;

carriage means disposed in said housing for reciprocating said deadbolt, said carriage means being movable in a direction transverse to the direction of reciprocation of said deadbolt;

a solenoid connected to said carriage means for reciprocation thereof; and a slide crank pivotally mounted in said housing and pivotally connected to said carriage means, said slide crank and said carriage means being arranged such that said carriage means can not be reciprocated by reciprocating said deadbolt.

2. The locking apparatus of claim 1 wherein said shutter has a flange thereon having a slot and said deadbolt has a groove therein operative to be received in said slot whereby when said shutter is movable said slot is interlocked with said groove in said deadbolt.

3. The locking apparatus of claim 2 further comprising a mailing machine having means for receiving an end of said deadbolt therein wherein when said shutter is movable the deadbolt is received in said receiving means.

4. The locking apparatus of claim 3 further comprising a return spring for returning said carriage to the position wherein said shutter is locked.

5. In a postage meter having a locking arrangement for locking a shutter for protecting an indicia print die, the improvement comprising a deadbolt assembly which includes:

a housing;

a deadbolt carried in said housing;

a slide crank and carriage disposed on said housing for reciprocating said deadbolt, said carriage being arranged for movement transverse to the direction of reciprocation of said deadbolt and having slots therein for receiving pins on said deadbolt;

a solenoid having a plunger connected to said carriage for reciprocating the carriage;

said slide crank being pivotally connected to said plunger and pivotally connected to said housing, the direction of travel of the deadbolt being on the common center of the slide crank pivot connection and the slots of the carriage which receive the pins of said deadbolt;

a shutter on said postage meter being movable between a position protecting a printing die and a position uncovering the die; and the deadbolt being movable between a first position wherein the deadbolt blocks movement of the shutter when the shutter is in the position protecting the die and a second position allowing movement of the shutter.

6. The locking arrangement of claim 5 wherein the shutter has a flange thereon having a slot and said deadbolt has a groove therein operative to be received in said slot whereby when said shutter is movable said slot is interlocked with said groove in said deadbolt.

7. The locking arrangement of claim 6 further comprising a mailing machine having means for receiving an end of said deadbolt therein wherein when said shutter is movable the deadbolt is received in said receiving means.

8. An improved locking apparatus for a postage meter having a shutter comprising:

a housing;

a deadbolt reciprocatingly mounted in said housing, said deadbolt being movable between a first position wherein a shutter for protecting a postage meter print die is movable and a second position where said shutter is locked;

carriage means disposed in said housing for reciprocating said deadbolt, said carriage means being movable in a direction transverse to the direction of reciprocation of said deadbolt;

a solenoid connected to said carriage means for reciprocation thereof; and a slide crank pivotally mounted in said housing and pivotally connected to said carriage means, said slide crank and said carriage means being arranged such that said carriage means can not be reciprocated by reciprocating said deadbolt; and said shutter having a slot and said deadbolt having a groove therein arranged to be received in said slot and interlocked therewith whereby when said shutter is movable said slot is interlocked with the groove in said deadbolt.

9. The locking apparatus of claim 8 further comprising a mailing machine having means for receiving an end of said deadbolt therein wherein when said shutter is movable the deadbolt is received in said receiving means.

10. The locking apparatus of claim 9 further comprising a return spring for returning said carriage to the position wherein said shutter is locked.

* * * * *